United States Patent [19]

Siebelt

[11] 4,394,848

[45] Jul. 26, 1983

[54] CENTRAL HEATING BOILER

[75] Inventor: Dirk B. L. Siebelt, Nuenen, Netherlands

[73] Assignee: AWB Apparatenfabriek Warmtebouw B.V., Beek en Donk, Netherlands

[21] Appl. No.: 285,837

[22] Filed: Jul. 22, 1981

[30] Foreign Application Priority Data

Aug. 4, 1980 [NL] Netherlands ..... 8004437
Aug. 4, 1980 [NL] Netherlands ..... 8004613

[51] Int. Cl.[3] ..... F22B 7/00

[52] U.S. Cl. ..... 122/13 R; 122/136 C; 122/367 C; 122/160

[58] Field of Search ..... 122/13 R, 14, 16–19, 122/367 A, 367 C, 136 C, 158, 160

[56] References Cited

U.S. PATENT DOCUMENTS

| | | | |
|---|---|---|---|
| 460,158 | 9/1891 | Pandee | 122/160 |
| 480,406 | 8/1892 | Kennedy | 122/17 |
| 529,121 | 11/1894 | Gandner | 122/160 |
| 588,016 | 8/1897 | Sadtler | 122/13 R |
| 2,440,998 | 5/1948 | Alexander | 122/19 |
| 3,734,066 | 5/1973 | Scheyen | 122/367 C |
| 4,169,431 | 10/1979 | Viessmann | 122/367 C |
| 4,192,259 | 3/1980 | Viessmann | 122/136 C |
| 4,327,672 | 5/1982 | Viessmann | 122/136 C |

FOREIGN PATENT DOCUMENTS

| | | |
|---|---|---|
| 1168929 | 4/1964 | Fed. Rep. of Germany . |
| 2383588 | 10/1978 | France . |

*Primary Examiner*—Henry C. Yuen
*Attorney, Agent, or Firm*—Diller, Ramik & Wight

[57] ABSTRACT

A central heating boiler comprising a combustion chamber, flue gas passages, a flue gas collecting chamber and a liquid jacket surrounding both the combustion chamber and the flue gas passages, the inner wall part of said jacket surrounding the flue gas passages being composed of interwelded section staves, of which each one confines a flue gas passages, said inner wall part being very rigid, all other wall parts of the jacket being made of sheet metal and having such shapes and dimensions, as to ensure that the thermal stresses set up by the differences in expansion and shrinkage of the wall parts of the jacket remain under the breaking point of the sheet metal wall parts of the jacket and their welded points.

4 Claims, 5 Drawing Figures

CENTRAL HEATING BOILER

Figure 1:
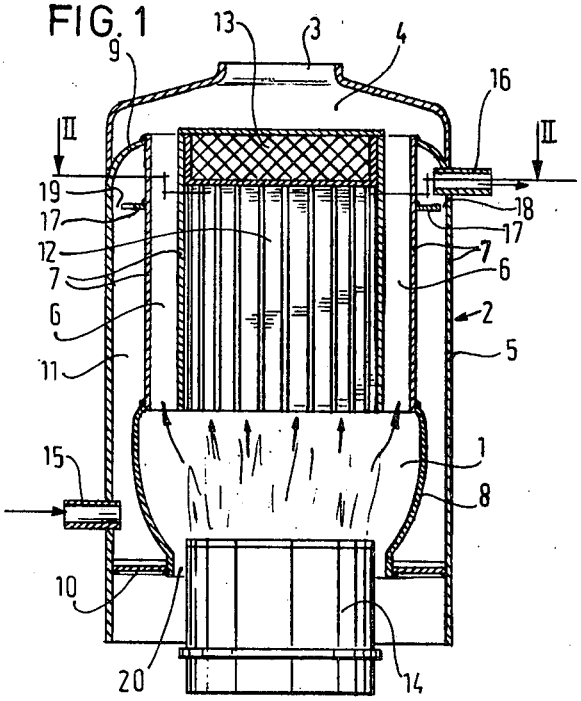

The invention relates to a vertical central heating boiler comprising from bottom to top a combustion chamber, in which at least a part of the burner is contained and the entire or nearly the entire flame extends, flue gas passages and a flue gas collecting chamber adapted to be directly or indirectly connected to a chimney, said boiler comprising in addition a liquid jacket surrounding both the combustion chamber and the flue gas passages, said jacket having an outer wall which mainly consists of a vertical tube of sheet metal, an inner wall consisting of two coaxial parts which are welded one to the other in a liquid-tight manner and of which the lower one is made of sheet metal and surrounds the combustion chamber throughout its entire height and the upper one extends between the combustion chamber and the flue gas collecting chamber and is composed of metal staves which bound the flue gas passages and are welded one to the other in a liquid-tight manner, said staves having each a cross sectional area which is at least defined by a flange extending along the circumference of the inner wall and on inwards pointing rib formed on said flange, the parts forming the end walls of said jacket being connected in a liquid tight manner to the outer and the inner wall of the jacket. A central heating boiler of this type is known and for instance disclosed in the West-German patent specification 1.168.929.

Up to now the experience has been that in boilers of this construction, of which the inner wall part composed of staves is very rigid, that means does practically not allow flexible deformation thereof, especially the liquid tight welded joints found in the upper end wall part of the liquid jacket present great difficulties due to the frequent and considerable temperature variations, to which a central heating boiler is normally exposed. Should in connection with the end wall parts no special measures be taken, the risk will be great that after some time cracks occur in the welded joints, but should the latter be very strong, in the metal sheet outer wall or in an end wall part. These difficulties owing to temperature variations are not only caused by differences in radial and axial expansion of the mentioned wall parts but also by the fact that a considerable tangential movement of the ends of the inner wall part considering of staves in respect of the sheet metal outer wall occurs. The risk of the liquid jacket becoming leaky will be greater as the temperatures in the boiler become higher and the staves of the inner wall are longer to meet the required capacity of the boiler.

The invention has the object to provide a central heating boiler of the construction described here above, which prevents the cracking of wall parts of the liquid jacket and welded joints found between said parts due to the frequently occurring temperature variations. This is achieved in that the maximum dimension in horizontal direction of at least one of the two end wall parts of the liquid jacket is greater than the horizontal distance between the outer wall and the staves of the inner wall of said jacket. An end wall part which is enlarged in horizontal or in respect of the vertical boiler axis in radial direction appears to make the flexible deformation required to avoid cracking of the welded joints and the wall parts of the liquid jacket which are directly or indirectly connected to the rigid inner wall part composed of staves possible in a simple and cheap manner.

For information it is observed that, should for obtaining a good boiler effiency the horizontal distance between the outer wall and the staves of the inner wall of the liquid jacket be made the usual 2–3 cm, fabourable results will be achieved, if for a boiler capacity of 12000–15000 kcal, 15000–18000 kcal, 18000–21000 kcal, 21000–25000 kcal, etc. the end wall part in question is so enlarged as to have a maximum dimension in horizontal direction of at least 3.5 cm, 4 cm, 5 cm, 6 cm, etc., respectively.

The central heating boiler may be constructed in different more or less simple ways. For instance, the outer wall of the fluid jacket may have an upper end part which is widened upwards in the shape of a cone or a bowl and said jacket may be closed at its upper end by a ring which is welded in a liquid tight manner at or near the upper edges of its outer and its inner wall to said walls. This ring may be a flat ring extending in a horizontal plane. However, the liquid jacket may also be closed at its upper end by a ring having a cross sectional area in the shape of a horizontal U, of which the legs point inwards said ring being welded in a liquid-tight manner at or near the upper edges of the outer and the inner wall of the jacket to said walls. It is true that in this case the ring-shaped upper end wall part has a more difficultly realizable shape, but the outer wall may be formed as simple a tube which is cylindrical from foot to top.

The lower end wall of the liquid jacket of the two boilers described here above may form a portion of the lower inner wall part surrounding the combustion chamber. In that case the lower inner wall part may advantageously have the shape of a bell or a cone which is welded in a liquid-tight manner with its lower edge to the outer wall of said jacket and with its upper edge to the lower edge of the upper inner wall part which is composed of staves.

Also the lower end of the liquid jacket may be provided with an end wall part which is enlarged in horizontal direction in order to decrease the thermal stresses in the wall parts of the jacket. Advantageously the boiler may then be constructed in such manner, that the lower part of the inner wall of the liquid jacket which surrounds the combustion chamber has the shape of a bowl which is welded in a liquid-hight manner with its wider upper edge to the lower edge of the upper inner wall part composed of staves and with its narrower lower edge of the inner edge of a ring forming the lower end wall of the liquid jacket, said lower part of the inner wall having an inner surface of such shape and condition as to be adapted to reflect radiation towards the combustion chamber and the staves of the upper part of said inner wall and having in its bottom an opening, through which the burner extends, and said lower end wall ring being welded in a liquid-hight manner with its outer edge to the outer wall of the liquid jacket. In this boiler also the lower end wall part of the jacket may be a flat ring extending in an horizontal plane. An additional advantage of this construction over that of the boiler disclosed in the precited West-German specification No. 1.168.929 is that nearly the entire flame radiation energy is transmitted directly or be means of the flue gases flowing through the flue gas passages to the inner wall and hence to the liquid contained in the liquid jacket, whereby the efficiency of the boiler is still further increased.

It is observed that by the French Utility model specification No. 2.383.588 a horizontal central heating boiler has become known, the liquid jacket of which has at the burner end an end wall part in the shape of a flat ring, of which the width is greater than the distance between the tubular outer wall and the also tubular inner wall of the liquid jacket. The flue gas passages extend to far within the combustion chamber and, as nothing has been said thereof, it must be assumed that said passages are, as usual, bounded by channels which are only locally, say by spot-welding, welded to the inner wall tube. Such a composite inner wall does not form such a rigid wall body as the inner wall part consisting of interwelded staves of the boiler according to the present invention, so that in this known boiler the problems caused by thermal stresses and found in boilers of the kind according to the invention do not occur. Consequently, the cited utility model specification does not teach, in what way said problems could be solved simply, cheaply and efficiently.

It has been found to be favourable to leave an annular gap for the admission of combustion air to the combustion chamber between the lower edge of the bowl-shaped lower part of the inner wall of the liquid jacket and the burner. The air passing through said gap neutralizes the unfavourable influence of the gas surge in the central space closed at its upper end and confined by the staves of the upper inner wall part of the liquid jacket. Thereby the otherwise irregular flames are stabilized and still a further improvement of the boiler efficiency is attained.

Figure 3:
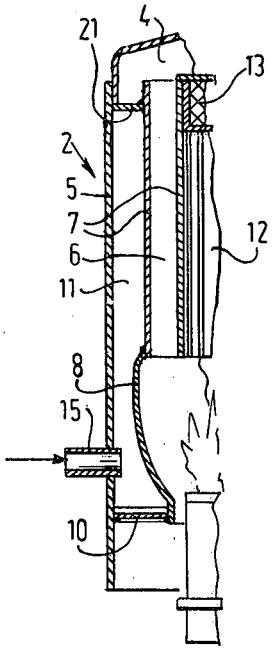
Figure 2:
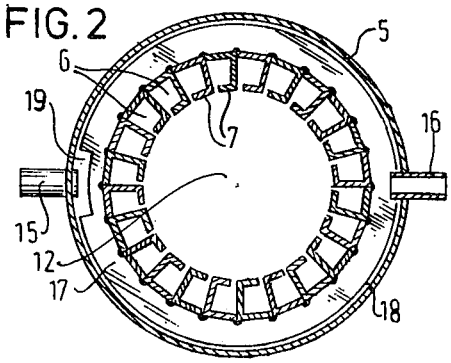
Figure 4:
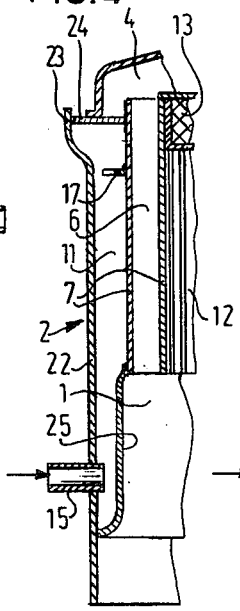
Figure 5:
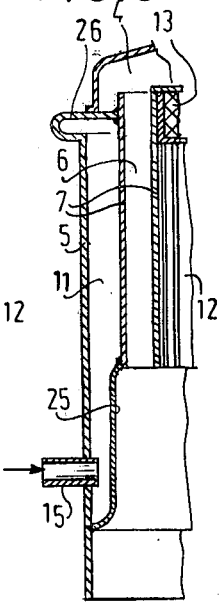

The invention will be further elucidated with the aid of the embodiments shown in the accompanying drawings. In the drawings:

FIG. 1 is a vertical sectional view of the body of a vertical central heating boiler constructed in accordance with the invention, FIG. 2 is a horizontal sectional view of said boiler body taken on line II—II in FIG. 1, FIG. 3 is a vertical sectional view of a part of a first variant of the liquid jacket of the boiler shown in FIGS. 1 and 2, FIG. 4 is a vertical sectional view of a part of a second variant of said liquid jacket and FIG. 5 is a vertical sectional view of a part of still an other variant of the liquid jacket.

The boiler body shown in FIGS. 1 and 2 comprises a combustion chamber 1, a liquid jacket 2 and a flue gas collecting chamber 4 adapted to be connected to a chimney passage through an opening 3. The liquid jacket comprises a cylindrical outer wall 5 of sheet metal, an inner wall composed of two coaxial parts of which the upper end consists of interwelded staves 7 bounding flue gas passages and having each a U-shaped cross sectional area, said staves and said passages extending from the combustion chamber 1 to the flue gas collecting chamber 4 and the bowl-shaped lower one 8 surrounds the entire combustion chamber 1 and is made of sheet metal, an upper end wall part 9 which is formed by the inwards bended upper end portion of the outer wall 5 which is welded to the staves 7 of the inner wall, a lower end wall part 10 formed by a flat horizontal ring, of which the edges are welded to the outer wall 5 and the lower inner wall part 8, and a liquid space 11. The horizontal width of the end wall ring 10 is greater than the horizontal distance between the outer wall 5 and the staves 7 of the upper inner wall part.

The central space 12 surrounded by the staves 7 and extending above the combustion chamber 12 is closed at its upper end by an insulating cover 13, so that the flue gas has to pass through the channels or staves 7 bounding the flue gas passages 7.

A gas or oilburner 14 extends through the bottom opening of the bowl-shaped lower inner wall part 8.

The liquid jacket is provided on substantially diametrically opposite sides with pieces of tubing 15,16 for the connection of the boiler to the external liquid circuit, one of said pieces of tubing being situated near the lower end and the other one being situated near the upper end of the liquid space 11.

In order to prevent that the liquid flows too directly, that means in oblique direction from the inlet 15 towards the outlet 16 of the liquid space 11, an annular baffle plate 17 is welded just below the outlet 16 to the staves 7. This baffle plate leaves along the greatest part of the inner circumference of the outer wall 5 a very narrow gap 18 and only in a place diametrically opposite the outlet 16 a wider passage 18. It has appeared that due to the baffle plate 17 the liquid flow in the jacket is guided along the hot inner wall 8,7 in such a manner as to ensure that the liquid takes up a greater amount of heat whereby the efficiency of the boiler is still more increased.

The staves 7 of the inner wall may have, instead of the U-shaped cross sectional area, an L- , a T- or an I-shaped or a still otherwise formed cross section area having one or more inwards directed ribs.

The bowl-shaped lower part 8 of the inner wall of the liquid jacket 2 has a so formed and constructed inner surface as to ensure that nearly all radiation emitted by the flame is reflected to the combustion chamber 1 and the central space 12, so that the greatest part of the radiation energy is transferred through the inner wall 7,8 of the liquid jacket 2 to the liquid contained in the liquid space 11, which also improves the boiler efficiency. Left between the narrower lower edge of the inner wall part 8 and the burner 14 is a narrow gap allowing combustion air to pass which neutralizes the unfavourable influence of the gas surge in the closed central space 12 on the flames of the burner. This has the effect that the flames will be much more stable which also results in an increase of the boiler efficiency.

The enlarged width of the lower end wall ring 10 has the main effect, that it is able to take up the material stresses owing to the frequent temperature variations and to the difference in thermal behaviour of the rigid immer wall part consisting of staves 7 and that of the remaining wall parts 5,8,9 of the liquid jacket 2, so that the risk of cracking of the latter wall parts and the welded joints is prevented. An additional effect of said ring is the greater quantity of liquid contained in the lower part of the liquid jacket, whereby the inner wall part surrounding the combustion chamber which becomes very hot is much better cooled.

The boiler construction illustrated in FIG. 3 differs from that of the boiler shown in FIGS. 1 and 2 in that the outer wall 5 is cylindrical up to its top and the upper end wall part of the jacket consists of a flat horizontal ring 21, of which the edges are welded to the staves 7 and the outer wall 5 and the width is equal to the radial distance between the staves 7 and the outer wall 5.

It is observed that it is not necessary to give the lower end wall a greater width for taking up the thermical stresses, as is shown in the embodiment illustrated in FIGS. 1, 2 and 3. Also the upper end wall of the jacket 2 may have the required enlarged width. For instance, the boiler shown in FIG. 4 is provided with an outer wall 22, of which the main part is cylindrical but the upper end portion 23 is widened as a bowl. The upper end of this bowl-shaped outer wall end portion 23 is closed by a flat horizontal ring 24, of which the edges are welded to said bowl-shaped wall portion 23 and the staves 7 of the inner wall and the width is greater than the distance between the staves 7 and the cylindrical portion 22 of the outer wall. The lower part 25 of the inner wall of the jacket surrounds the combustion chamber 1 and has the shape of a bell, of which the narrower upper edge is welded to the lower ends of the staves 7 and the wider lower edge is welded to the outer wall 2. The lower end portion of this bell-shaped wall 25 thus forms at the same time the lower end wall part of the liquid jacket 2.

The boiler illustrated in FIG. 5 differs from that shown in FIG. 4 in that the outer wall 5 is cylindrical up to its top and the upper end wall part is a ring 26 having a U-shaped cross sectional area with unequal legs pointing towards the vertical boiler axis. The edge of the ring 26 nearest to said axis is welded to the staves 7 and the edge thereof remotest from said axis is welded to the outer wall 5. The maximum width of the ring 26 is greater than the distance between the staves 7 and the outer wall 5.

Within the scope of the invention other embodiments are possible. For instance, both end walls of the liquid jacket may have the greater width referred to hereabove. Consequently, the upper end of the jacket of the boiler shown in FIG. 1 may be constructed as is shown in FIG. 4 or 5.

What I claim is:

1. A boiler construction comprising, in combination:

a pair of upright, coaxial wall constructions comprising an outer wall of sheet metal having essentially a cylindrical shape and an inner wall formed for a substantial extent of its length by a group of longitudinally extending stave elements joined by weldments to provide a liquid tight cylindrical upper portion of the inner wall having a predetermined spacing from said outer wall, said inner wall also including a lower portion in the form of a bell shaped skirt of sheet metal defining a combustion chamber welded to said upper portion at the lower end thereof and spaced inwardly from the lower portion of said outer wall, said stave elements defining longitudinally extending flue gas passages at the inner side of said upper portion of the inner wall, which flue gas passages are in communication with the core region of said inner wall portion, and there being a closure means for said core region at that end thereof opposite said combustion chamber; and wall means joining said inner wall construction to said outer wall construction for forming a water jacket between such inner and outer wall constructions and for relieving the boiler construction of destructive mechanical stresses due to unequal thermal stresses which occur in normal operation of the boiler, said wall means comprising first and second annular wall portions of different radial widths respectively extending radially between the upper end of said upper portion of the inner wall and the outer wall and between the lower end of said combustion chamber and the outer wall whereby the spacing between the inner and outer wall constructions and the spacing between said annular wall portions defines a relatively small volume such that water therein is heated rapidly to temperature, inlet and outlet means for flowing water into said small volume, said skirt which defines the combustion chamber having its upper end of a diameter substantially the same as the diameter of said upper portion of the inner wall and having its lower end of a different diameter so that the radial width of one of the annular wall portions is sufficiently greater than the radial width of the other annular wall portion as to relieve said boiler construction of said destructive thermal and mechanical stresses.

2. A boiler construction according to claim 1 wherein said predetermined spacing is in the order of 2–3 cm, said one annular wall portion having a radial width in the order to 3.5–6 cm.

3. A boiler construction according to claim 1 wherein the lower end of said combustion chamber is flared inwardly and said one annular wall portion is at the lower end of the combustion chamber.

4. A boiler construction according to claim 1 wherein the lower end of said combustion chamber is flared outwardly to define said other annular wall portion.

* * * * *